United States Patent [19]

Hoffmann

[11] 4,036,284

[45] July 19, 1977

[54] CONTINUOUS CASTING APPARATUS FOR SLABS

[76] Inventor: Rudolf Hoffmann, Heyenfeldweg 50a, Krefeld, Germany, 415

[21] Appl. No.: 664,564

[22] Filed: Mar. 8, 1976

[30] Foreign Application Priority Data

Mar. 19, 1975 Germany ..... 2511913

[51] Int. Cl.[2] ..... B22D 11/128

[52] U.S. Cl. ..... 164/280; 164/281 R; 164/282; 29/115; 100/172; 100/176; 198/787

[58] Field of Search ..... 198/127 R; 29/115; 100/172, 176; 164/273 M, 280, 281, 282, 82

[56] References Cited

U.S. PATENT DOCUMENTS

| | | | |
|---|---|---|---|
| 151,253 | 5/1874 | Tothammer | 198/127 R |
| 295,791 | 3/1884 | Milne | 198/127 R |
| 2,110,942 | 3/1938 | Piquerez | 198/127 R X |
| 3,358,743 | 12/1967 | Adams | 164/281 UX |
| 3,483,915 | 12/1969 | Schneckenburger et al. | 164/282 X |
| 3,566,955 | 3/1971 | Krall | 164/282 |
| 3,717,197 | 2/1973 | Strack et al. | 164/280 X |
| 3,770,103 | 11/1973 | Ball et al. | 198/127 R |

FOREIGN PATENT DOCUMENTS

| | | |
|---|---|---|
| 1,950,772 | 4/1971 | Germany |

*Primary Examiner*—Ronald J. Shore
*Attorney, Agent, or Firm*—John J. Dennemeyer

[57] ABSTRACT

In a continuous casting apparatus for slabs, the driven guide rollers of two closely adjacent casting guide tracks are driven from the outside of one and the same guide track so that the outside of the other guide track is free of driving motors, and at least a third guide track can be added thereto while maintaining the smallest possible width of the whole apparatus in order to deliver melt from a single distributor groove to the moulds of the individual guide tracks.

10 Claims, 4 Drawing Figures

CONTINUOUS CASTING APPARATUS FOR SLABS

Figure 1:
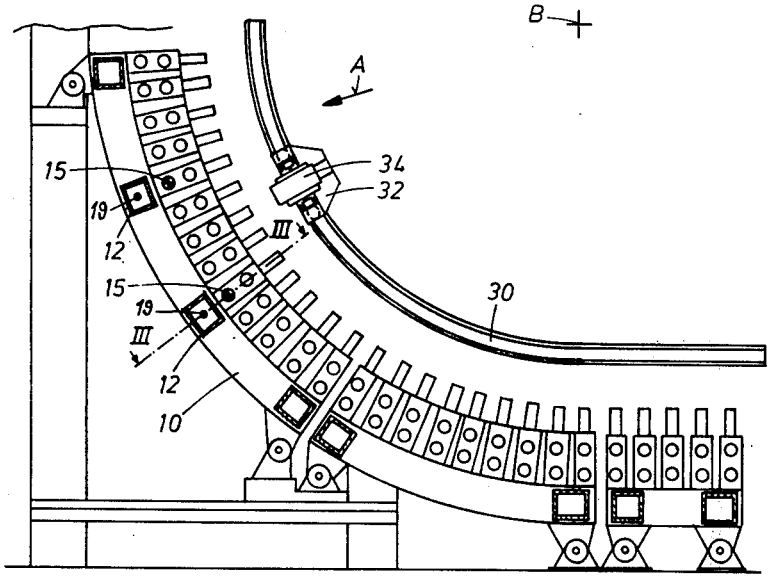

The invention relates to a continuous casting apparatus for slabs having at least two casting guide tracks each of which is provided with a mould, and having a distributor groove common to the moulds for distributing and supplying to the moulds molten metal poured from a ladle of large capacity, wherein some of the guide rollers of the guide tracks are driven individually from one of the free sides of the guide tracks.

Heretofore continuous casting apparatus for slabs could be built only with at most two continuous casting tracks because of the space requirement for the individual guide tracks and the roller drives therefor, since by placing in series more than two guide tracks — when large charge weights were to be cast in one operation from a single ladle — the length of the common distributor groove becomes too great as the width dimension of the casting cross-sections increases. As the length of a distributor groove increases, there increases also the surface of the melt located therein whereby not only an increased temperature loss occurs because of radiation, but also the large liquid surface is exposed to an increased and damaging oxygen attack. Also steel works require a limitation of the width dimension of the continuously cast slabs and connect therewith the demand that nevertheless maximum charge weights of the order of magnitude of 400 tons and more can be cast.

It has therefore been already considered either to divide the moulds in order to produce in each casting guide track a pair of continuous bars, whereby problems of many kinds arise from the length of the guide rollers in respect of the bending and adjustment thereof, or it has been tried to attempt the method of casting wide slabs which are divided by flame cutting after they leave the secondary cooling zone. In this case, however, it must be expected that disadvantageous oxygen inclusions occur in the region of the separation gap where an incompletely constructed metallurgical microstructure is present.

The invention is based on the problem to provide the conditions for permitting a multiple track continuous casting apparatus for slabs to be constructed, wherein the number of tracks can be increased without an increase of the length of the distributor groove in a measure corresponding to the number of tracks such as would have to be expected when the construction of roller drives according to the state of the art is taken into account. Starting from the presence of two guide tracks and in recognition of the fact that it is the configuration of the roller drives which has prevented heretofore a closer placing together of a plurality of casting guide tracks it is proposed according to the invention that the driven rollers of a second guide track are drivable from the free outer side of the first guide track, so that all driving motors for rollers are disposed at the same outer side of the first guide track and that both guide tracks are disposed as closely adjacent each other as possible.

It is attained thereby that one outside of a twin guide track is free of driving motors, whereby it is rendered possible to dispose adjacent the second guide track a third guide track the driven rollers of which are driven from the free outer side, or to enlarge the continuous casting apparatus to two twin guide tracks which are disposed mirror symmetrically to each other and each of which has a first and a second casting guide track.

Two different solutions are offered within the scope of the invention for the problem on which the invention is based. The one solution consists in that the driven roller of the second guide track is driven by always one shaft which crosses both tracks and which extends to the outside of the second guide track, a driving connection of small construction being provided between the shaft end and the roller to be driven. This driving connection determines the extent of the gap which must be left free between a third guide track and a further twin guide track. The shafts crossing the two tracks are advantageously guided through tubular cross members of an arc-shaped carrier frame of each guide track. The other solution consists in that the driven rollers of the second guide track are each connected to a driven shaft which traverses, in the form of a carrier shaft, the in-line roller of the first guide track the roller being in the form of an idler roller freely rotatably mounted on this carrier shaft, and an adjacent roller of the first guide track being positively driven. In this solution the free outside of the second guide track is also free of any driving connection so that a third guide track or a further twin guide track can be located directly adjacent the second guide track. This second solution starts from the consideration that the driven rollers of two adjacent guide tracks need not be necessarily aligned with each other.

With a view to saving space in the width dimension of a guide track the invention can be realised with particular advantage with a known curved casting guide track frame according to German AS No. 1,950,772 wherein each guide track consists of an arc-like carrier frame with two parallel frame parts which are connected to each other by means of tubular cross members, wherein the curved frame parts are provided with pockets open towards the centre of curvature for receiving the stub axle bearings of the rollers. In contrast to the so-called segmentary manner of construction of a casting guide track for example according to German Patent Specification No. 1,239,440, in the curved guide track frame with individual roller bearings the spacing of the stub axle bearings from each other in the carrier frame parts determines directly the space requirement for the width of the carrier frame or frames and thus the guide tracks. Moreover, compared with the segmentary manner of construction, the additional advantage occurs that the rollers of all guide tracks can be dismantled individually or even in pairs in a direction towards the centre of curvature of the curved guide tracks. This dismantling direction has no effect on the space requirement of a guide track. For dismantling the rollers, a roller dismantling device is provided which is common to all rollers of a plurality of adjacently disposed guide tracks and which consists of a cross member which extends over the total width of the apparatus and which is guided in arc-shaped running rails with a dismantling carriage displaceable transversely to the guide tracks. Each roller pair of each guide track can be driven for assembly and dismantling by means of the displaceable cross member and the dismantling carriage which is displaceable transversely to the guide tracks.

The invention has the effect that at least two moulds lie so closely adjacent to each other that for changing the slab width the two narrow walls of the moulds cannot both be adjusted any more without difficulties. Therefore the invention provides that only the outwardly disposed narrow walls of the moulds are adjustable. Also it is considered advantageous that the moulds of a twin track are disposed on a common lifting table.

Figure 2:
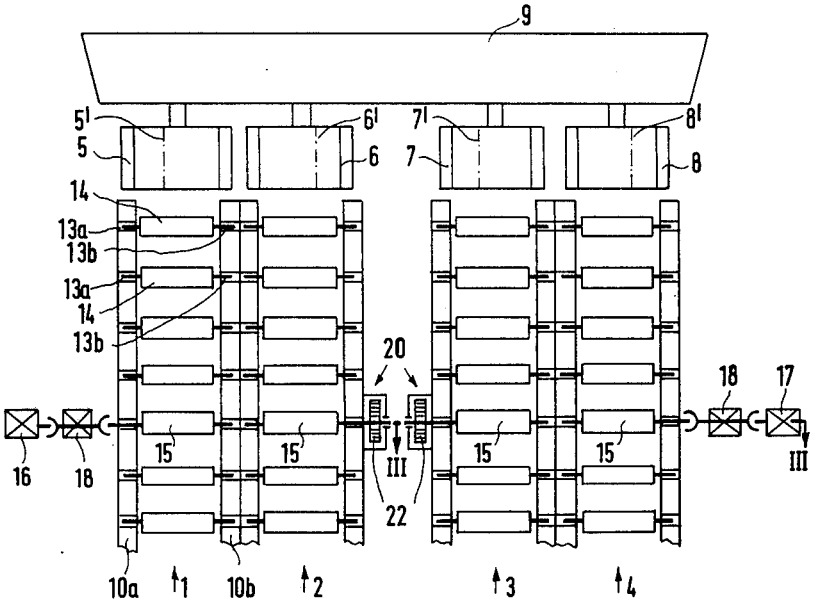
Figure 3:
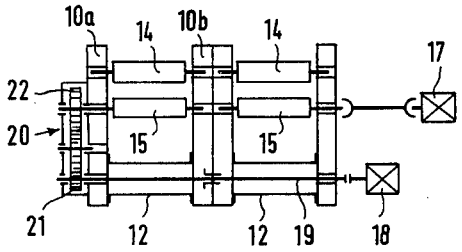
Figure 4:
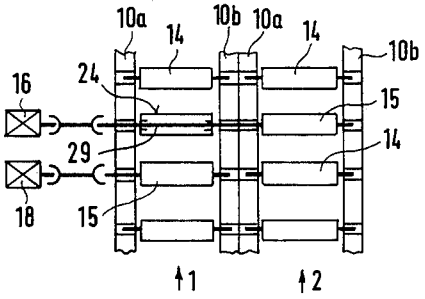

An embodiment of the invention in the form of a continuous casting apparatus for slabs having two twin casting guide tracks with two different constructional examples for the roller drive is described below with reference to the accompanying drawings, in which:

FIG. 1 illustrates continuous casting apparatus in side view,

FIG. 2 is a diagrammatic illustration of a partial view of the apparatus in the direction of arrow A in FIG. 1, the arc-shape being developed in the plane of the drawing, and with the adjustable guide rollers disposed on the inner arc omitted, FIG. 3 illustrates a section on the line III — III in FIG. 1, and FIG. 4 is a section of a view according to FIG. 2 for illustrating a constructional example differing from FIGS. 1 to 3.

In the constructional example the continuous casting apparatus according to the invention consists of four casting guide tracks 1, 2, 3 and 4 of which the closely adjacent guide track pairs 1, 2, and 3, 4, each constitute a twin guide track. Each guide track is associated with a mould 5, 6, 7 and 8 the respectively outwardly disposed walls of which are adjustable for changing the slab width, as is indicated by dash dotted lines at 5', 6', 7' and 8' for a narrow slab width. All four moulds are supplied with melt by a common distributor groove 9.

According to FIGS. 1 and 2 each guide track consists of a multiple part arc-shaped carrier frame 10 which in turn consists of two parallel frame parts **10*a* and 10*b* which are maintained spaced from each other by tubular cross members 12 (FIGS. 1 and 3). The curved frame parts 10*a* and 10*b* are provided with pockets 13*a* and 13*b* open towards the centre of curvature B (FIG. 2) in which pockets the stub axle bearings of guide rollers 14 are guided. In FIG. 2 only a few of the visible radially inner guide rollers 14 underneath the moulds 5 to 8** illustrated.

It is clear from FIG. 1 that two of the radially outer guide rollers 15 of all guide tracks are driven, i.e. the conventionally non-adjustable rollers of the radially outer part circular arc of the roller guide. FIG. 2 illustrates the row of driven outer rollers 15 through which the section on the line III—III in FIG. 1 extends. It may be seen from FIG. 2 that the guide roller 15 of the first outer guide track 1 (and this applies also to the guide roller on the same axis of the other outer guide track 4) is directly driven in the usual manner from the outside by a motor 16 or 17, respectively.

The drive of the guide rollers 15 of the mutually facing guide tracks 2 and 3 occurs according to the invention also from the free outsides of the guide tracks 1 and 4, namely — as shown in FIG. 3 — in each case from a respective motor 18 by means of two shafts 19 crossing closely adjacent guide tracks 3, 4 and 1, 2, respectively, and a driving connection 20 of small construction at the adjacent inner sides of the guide tracks 2 and 3. Each shaft 19 is guided through a tubular transverse member 12 between the frame parts **10*a* and 10*b* of each carrier frame 10. Each driving connection 20 consists in the constructional example of a spur wheel drive with reduction gearing, the input pinion 21 of which is securely mounted on the inwardly disposed end of the respective shaft 19. The last spur wheel 22 is mounted on the extended bearing pin of each guide roller 15.**

Owing to the drive according to the invention of the guide rollers 15 of the two inwardly disposed guide tracks 2 and 3 it is possible to dispose two mirror symmetrically equal twin guide tracks 1, 2 and 3, 4, respectively, as closely adjacent each other as it is desirable, taking into account an intermediate space for a walkway as illustrated in FIG. 2. High charge weights can be cast from a common distributor groove 9 the length of which is maintained within limits. A further reduction of the space requirement of a twin guide track 1, 2 or 3, 4, respectively, can be obtained in that the adjacent carrier frame parts **10*b* and 10*a*** are unified.

Even if only one further third casting guide track with rollers driven from the outside is to be disposed adjacent a twin guide track 1, 2, the space gained by the driving connections 20 of small construction at the guide track 2 has an advantageous effect.

The constructional example illustrated in FIG. 4 differs from the solution according to FIG. 3 and relates to the two guide tracks 1 and 2. The major number of the guide rollers of the guide tracks are idler rollers 14. The driven rollers 15 of the first guide track are directly driven by driving motors 18. For driving each roller 15 of the second guide track 2 a driving motor 16 is provided on the same outside of the first guide track 1 and drives a carrier shaft 29 which crosses the first guide track and which is mounted in pockets of the adjacent frame parts **10*a* and 10*b* of both guide tracks and on which a freely rotatable idler roller 24 is mounted in the region of the first guide track 1. The carrier shaft 29 is constructed in the region of the second guide track 2 in the form of a roller 15 or is rigidly connected to a roller jacket so that this roller 15 of the second guide track 2 is positively driven by means of the carrier shaft 29. In this manner the outside of the second guide track 2 is completely free of driving elements for driven rollers 15** of this guide track so that a further guide track or a twin guide track be additionally provided in a mirror-symmetrical manner relative to the illustration, there being no additional space requirement for driving motors affecting the length of the common distributor groove. The driving motors are disposed exclusively at the outsides of the respective outer guide track.

For dismantling the individually mounted guide rollers inwardly towards the centre of curvature B, there serves a cross member 32 which is displaceable in a rail pair 30 and which extends over the total width of the continuous casting apparatus; a carriage-like dismantling carriage 34 is guided by the rails and in the constructional example according to FIG. 4 it must be so constructed that the in-line rollers of a twin guide track can be dismantled simultaneously.

What is claimed is:

1. Continuous casting apparatus for slabs, comprising:

first and second mould means, arranged in closely spaced, side-by-side relationship;

a common distributor groove for supplying melt to said mould means;

first and second independent guide tracks operatively connected respectively to said first and said second mould means, and arranged in side-by-side relationship located as closely adjacent each other as possible, each of said independent guide tracks having idler rollers and individually driven rollers for guiding a cast slab;

first motor means located on the free outside of said first guide track, and connected to the driven rollers of said first guide track;

second motor means also located on the free outside of said first guide track; and drive shaft means extending across said first guide track from said second motor means to the driven rollers of said second guide track, and connected to said driven rollers of said second guide track.

2. Continuous casting apparatus according to claim 1, wherein said drive shaft means for each driven roller of said second guide track extends through an idler roller of said first guide track means and is connected to the end of an aligned driven roller of said second guide track, the idler roller of said first guide track through which said drive shaft means extends being mounted for free rotation on said drive shaft means passing therethrough.

3. Continuous casting apparatus according to claim 1, wherein said drive shaft means associated with each driven roller of said second guide track crosses both tracks and extends to the free outside of the second guide track, and wherein a driving connection is provided between the respective drive shaft means end and the driven roller on the free outside of said second guide track.

4. Continuous casting apparatus according to claim 3, wherein the drive shaft means crossing both tracks are guided through tubular cross members of an arc-shaped carrier frame of each guide track.

5. Continuous casting apparatus according to claim 1, comprising additionally a third guide track, the driven rollers of which are driven from the free outside thereof.

6. Continuous casting apparatus according to claim 1, comprising two twin casting guide tracks which are disposed mirror-symmetrically to each other and each of which has a first and a second casting guide track.

7. Continuous casting apparatus according to claim 6, wherein each guide track comprises an arc-shaped carrier frame with two parallel frame parts which are provided with pockets open towards the centre of curvature of the frame for receiving stub axle bearings of the rollers, wherein all guide tracks are associated with a common roller dismantling device comprising a transverse member which extends over the total width of the apparatus and which is guided in arc-shaped running rails and on which a dismantling carriage is guided which is displaceable transversely to the guide tracks.

8. Continuous casting apparatus according to claim 1, having adjustable moulds for changing the width of the slabs, wherein only the outwardly disposed narrow walls of the moulds are adjustable.

9. Continuous casting apparatus according to claim 1, wherein the moulds of a twin track are disposed on a common lifting table.

10. Continuous casting apparatus for slabs, comprising: first and second mould means; a common distributor groove for supplying melt to said mould means; first and second casting guide tracks operatively connected respectively to said first and second mould means, each of said guide tracks having idler rollers and individually driven rollers for guiding a cast slab; and motor means for driving said driven rollers, wherein said motor means for driving the driven rollers of said first guide track and said motor means for driving the driven rollers of said second guide track are disposed on the same free outside of said first guide track, and wherein said first and second guide tracks are located as closely adjacent each other as possible, the driven rollers of the second guide track each being connected to a driven shaft which traverses in the form of a carrier shaft the in-line roller of the first guide track, the said roller being in the form of an idler roller which is freely rotatably mounted on this carrier shaft, and wherein an adjacent roller of the first guide track is positively driven.

* * * * *